United States Patent [19]

McCreery et al.

[11] Patent Number: 4,650,186

[45] Date of Patent: Mar. 17, 1987

[54] SUPINE BENCH WITH LEG OPERATED FREE WEIGHT CATCH

[76] Inventors: Michael J. McCreery, 1914 Alberti Dr., Silver Spring Montgomery, Md. 20902; Gary D. Waithall, 542 N. Galloway St., Xenia Greene, Ohio 45385; George R. Parker, III, Star Route A, Box 9CCC, Flemington Hunterdon, N.J. 08822

[21] Appl. No.: 610,541

[22] Filed: May 15, 1984

[51] Int. Cl.[4] ..... A63B 21/06

[52] U.S. Cl. ..... 272/134; 272/123; 272/118

[58] Field of Search ..... 272/134, 118, 123, 122, 272/93, 117, 144, DIG. 4, 96

[56] References Cited

U.S. PATENT DOCUMENTS

| | | | |
|---|---|---|---|
| 3,743,282 | 7/1973 | Zinkin | 272/134 X |
| 3,820,782 | 6/1974 | Salkeld | 272/134 X |
| 4,149,714 | 4/1979 | Lambert | 272/134 X |
| 4,169,589 | 10/1979 | McArthur | 272/134 X |
| 4,249,726 | 2/1981 | Faust | 272/123 |
| 4,252,314 | 2/1981 | Ceppo | 272/117 |
| 4,256,301 | 3/1981 | Goyette | 272/123 |
| 4,262,901 | 4/1981 | Faust | 272/144 X |
| 4,382,596 | 5/1983 | Silberman | 272/118 |
| 4,407,495 | 10/1983 | Wilson | 272/117 |
| 4,511,137 | 4/1985 | Jones | 272/134 X |

*Primary Examiner*—Richard J. Apley
*Assistant Examiner*—John L. Welsh
*Attorney, Agent, or Firm*—Harvey B. Jacobson

[57] ABSTRACT

An elongated bench support including head and foot ends is provided for disposition in generally horizontal or inclined position and against which a person wishing to carry out bench press exercises may repose on his or her back. Upstanding guide structure is disposed adjacent the head end of the bench support and follower structure is mounted thereon for guided movement therealong. The follower structure includes weight bar supporting structure for supporting a weighted bar therefrom and a foot engageable support is mounted from the foot end of the bench support for guided movement generally longitudinally of the bench support. Motion transmitting structure operatively connects the foot engageable support and the follower structure for raising and lowering the latter responsive to movement of the foot engageable support away from and toward the head end of the bench. Further, releasable ratchet-type latch structure is operatively associated with the follower structure for releasably latching the follower structure against downward movement relative to the guide structure. The foot engageable support includes latch operator structure shiftably supported therefrom for selectively actuating and releasing the latch structure.

16 Claims, 7 Drawing Figures

SUPINE BENCH WITH LEG OPERATED FREE WEIGHT CATCH

BACKGROUND OF THE INVENTION

The bench press is one of the most universally used barbell exercises. This exercise is used by both genders to increase muscular tone and strength in the upper body for better appearance as well as greater performance in athletic competition. Traditionally, a bench press exercise is performed while lying face up on a flat bench and gripping a weighted bar or barbell with both hands spaced about shoulder width apart. The barbell, whose weight can be varied by addition or removal of weights on each end, is first held at arm's length, lowered to the chest and then raised back to the starting position. This movement constitutes one repetition.

For convenience most conventional benches upon which bench press exercises are to be performed have integral uprights which support the barbell at a level slightly less than arm's length above the bench when the exercise is not being performed. To perform an exercise "set", the exerciser raises the barbell off of the standards, performs a variable number of repetitions and then places the barbell back on the vertical supports.

Even though the bench press has tremendous functional benefits and is therefore very popular, by its very nature it is one of the most dangerous of all barbell exercises. In the starting position, the exerciser holds a weight above his chest, neck and head. Momentary loss of balance, consciousness or strength can result in injuries ranging up to permanent disabilities. Cases have been reported in which an exerciser has sustained critical injuries to the head or neck from barbell impact.

Even if the weighted barbell is not dropped, an error in judgment in the weight attempted or the onset of fatigue can result in the inability of the exerciser to raise the weight off his chest. At this point, he becomes "trapped" under the barbell. If the weight is sufficiently light, the barbell can be rolled down the chest and abdomen to a position on the hips and legs where it can then be removed by the lifter first sitting and then standing up. However, this procedure could be injurious to the lifter if the barbell weighs in excess of 200 lbs. Therefore, under these conditions he must wait for another person to remove the weight from his chest.

In order to reduce the risk of being trapped or injured by a weight, most well run exercise facilities require close supervision of those persons using the bench press. This is usually accomplished by a "spotter" or lifting companion, coach or weight training adviser. The spotter must have comparable strength to that of the lifter and be willing to be attentive to the person carrying out bench press exercises. Unfortunately, a conscientious spotter is not always available. Although the absence of a spotter should preclude doing bench presses, it usually means the exerciser will perform bench presses alone, always running the risk of sustaining a serious injury. This is problematic in a commercial exercise facility where questions of liability can be raised.

In addition to providing safety for the lifter, a spotter may also extend the normal limits of exercise of the lifters. For example, the spotter can provide assistance in completing additional repetitions in an exercise at a point where the lifter is fatigued. Exercises carried out at this point are called "forced repetitions" and enhance the lifter's capability to gain strength by his maximum exertion during these movements.

A spotter can also assist in so called "negative repetitions". These repetitions are performed in a reverse direction than normal with a weight greater than can be lifted. That is, the weight is lowered to the chest in a controlled fashion. Since the weight exceeds the capacity of the lifter, a spotter must be present to raise the barbell back to the starting position. The advantage of this movement is that maximal effort is used in each repetition just to control the barbell's descent.

It is evident that heretofore in order to maximize both performance and safety in the bench press, a spotter must be present. However, even under the best conditions, assistance and supervision from a spotter is not perfect. If an injury is incurred during a heavy lift, it is very difficult for the spotter to react quickly enough to catch the weight. Moveover, the spotter is usually in a mechanically disadvantaged position to control the barbell and must rely almost totally on arm strength. Accordingly, a need exists for an exercise bench for carrying out bench press exercises and which may be used for bench press exercises with considerably greater safety to the exerciser.

Examples of various different forms of bench press apparatuses including some of the general structural and operational features of the instant invention are disclosed in U.S. Pat. Nos. 4,216,959, 4,249,726, 4,252,314, 4,253,662 and 4,256,301.

BRIEF DESCRIPTION OF THE INVENTION

The exercising apparatus of the instant invention is specifically designed to enable an exerciser to perform bench press exercise with maximum safety functionality. A generally horizontal bench is provided for receiving the exerciser in supine position and the head end of the bench includes laterally spaced opposite side uprights from which followers are guidingly supported. The followers include horizontal front-to-rear extending bars for supporting the opposite ends of a weighted bar and the foot end of the bench includes foot support structure mounted therefrom for movement toward and away from the head end of the bench. Motion transmitting structure is operatively connected between the foot support structure and the followers whereby the latter are displaced upwardly responsive to movement of the foot support structure away from the head end of the bench. Thus, the strength of the legs of an exerciser is always available to him for assisting his arms in upwardly displacing a weighted bar away from his chest.

Further, the motion transmitting structure has releasable ratchettype latch structure operatively associated therewith to selectively terminate downward movement of the followers and the latch structure includes latch operator structure selective foot operation to selectively actuate and release the latch structure.

The main object of this invention is to provide a bench press exercising apparatus incorporating safety which will enable the user of the bench to use the strenght of this legs in assisting movement of a weighted bar away from the user's chest.

Still another object of this invention is to provide a bench press exercising apparatus includng latch structure operative to latch weighted bar supporting followers against movement toward the exerciser's chest.

A further object of this invention is to provide a bench press execising apparatus which will enable partial lighting movements to be carried one with great safety.

Still another important object of this invention is to provide the latch structure mentioned immediately above with operator structure under the control of the feet of the user of the bench press exercising apparatus, whereby the latch structure may be actuated and released momentarily as desired or needed by a person using the bench press exercising apparatus.

A final object of this invention to be specificaly enumerated herein is to provide a bench press exercising apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparatus reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
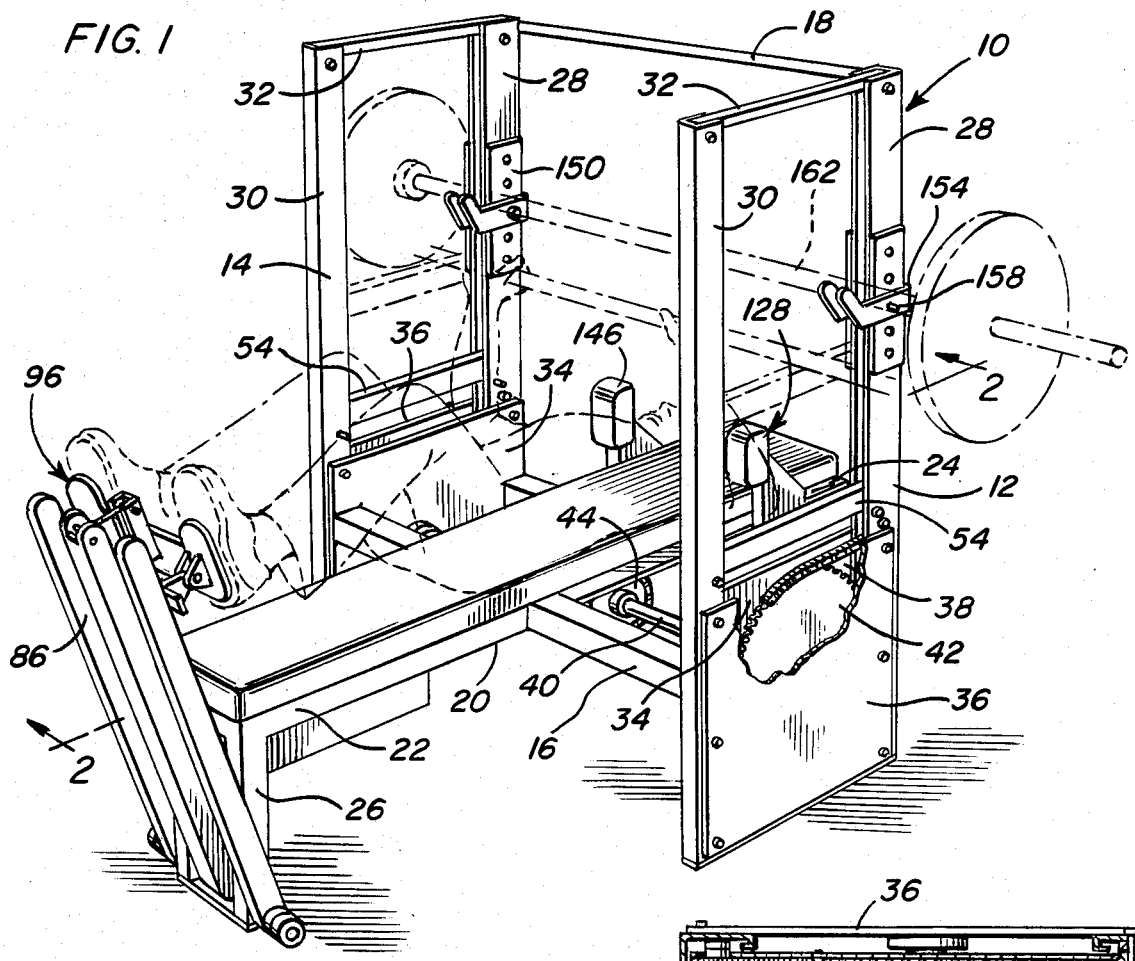
FIG. 1 is a perspective view of the exercising apparatus of the instant invention.
Figure 3:
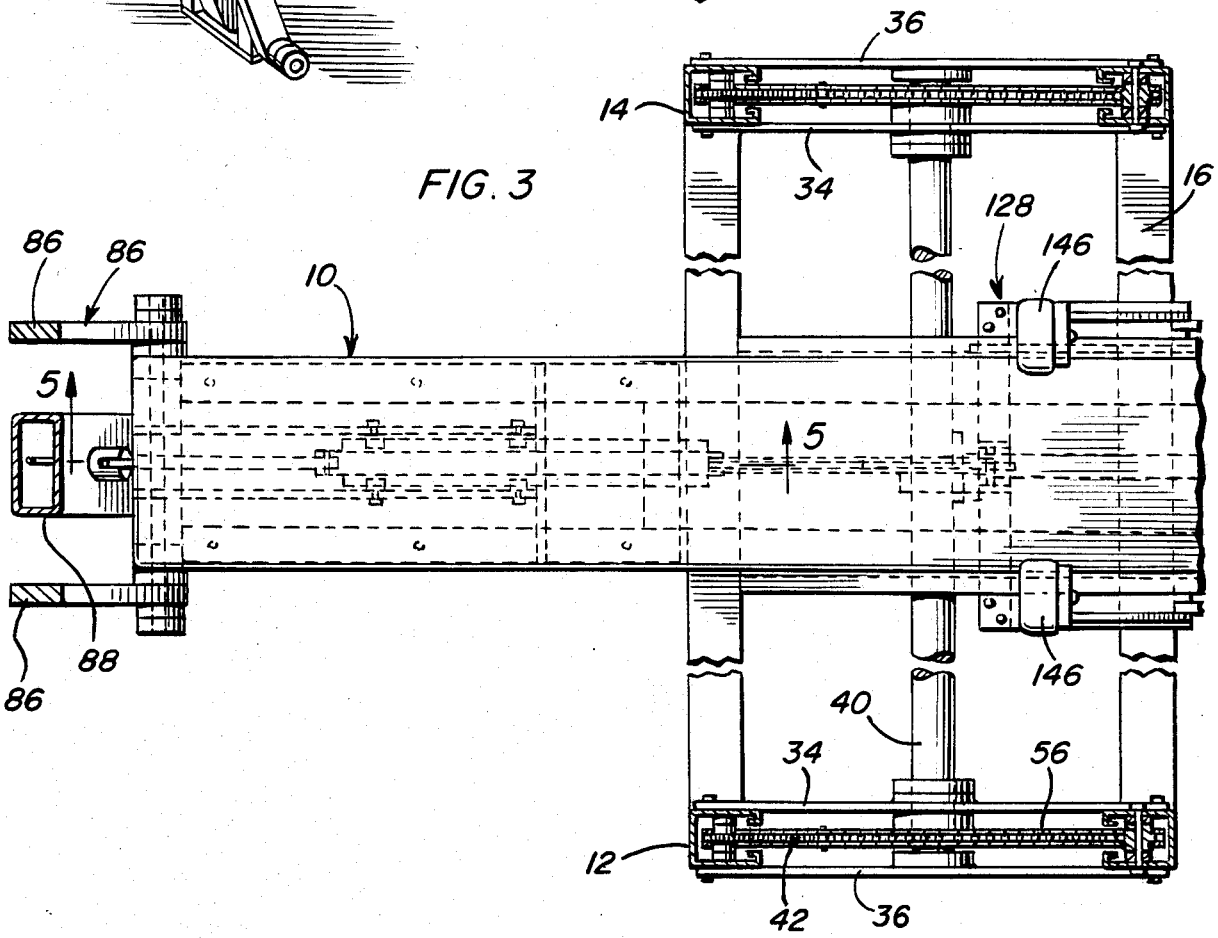
FIG. 3 is a fragmentary horizontal sectional view taken substantially upon the plane indicated by the section line 3—3 of FIG. 2.

Referring now more specifically to the drawings, the numeral 10 generally designates the exercising apparatus of the instant invention. The apparatus 10 includes a pair of upstanding opposite side side members 12 and 14 interconnected a spaced distance above their lower extremities by a main transverse brace frame 16 and also interconnected at their upper ends by a transverse bracing bar 18. The main brace frame 16 includes a central longitudinal portion 20 thereof defining foot and head ends 22 and 24 and the foot end 24 includes depending opposite side legs 26.

The side members 12 and 14 each include front and rear upstanding members 28 and 30 interconnected at their upper ends by a brace 32 and the lower ends of the side members 12 and 14 have inner and outer cover plates 34 and 36 secured between the front and rear upstanding members 30 and 28 thereof to define hollow compartments 38 in the lower portions of the side members 12 and 14. A transverse shaft has its opposite ends journalled from the cover plates 34 and 36 and a pair of large sprocket wheels 42 are mounted on the remote ends of the shaft 40 within the compartments 38. The central portion of the shaft 40 has a small diameter sprocket wheel 44 mounted thereon. Each of the side member front upright members is hollow and includes first and second upper and lower sprocket wheels 46 and 48 journalled therein and each of the rear upstanding members 30 is also hollow and includes a pair of upper and lower sprocket wheels 50 and 52 journalled therein. The upright members 28 and 30 define rearwardly and forwardly opening channel members, respectively, and each pair of corresponding front and rear upstanding members 28 and 30 guidingly engages the front and rear ends of a front-to-rear extending follower bar 54 therefrom. The front and rear ends of each bar 54 have corresponding ends of a pair of link chain sections 56 anchored relative thereto as at 58 and the link chain sections 56 extend upwardly from the bar 54, over the sprocket wheels 46 and 50, downwardly and toward and beneath the sprocket wheels 48 and 52 and are then meshed with the large sprocket wheel 42 and anchored relatively thereto as at 60.

The longitudinal portion 20 is separable from the main transverse base frame 16 and includes a pair of opposite side underside flanges 62 from which guide rollers 63 are journalled. A follower 64 is guidingly supported from the rollers 63 for longitudinal shifting along the longitudinal portion 20. The longitudinal portion 20 includes an abutment flange 66 to which one end of an expansion spring 68 is anchored as at 70 and the other end of the expansion spring is anchored as at 72 to an opposing flange 74 of the follower 64.

The follower 64 includes a rack gear 76 anchored relative thereto and extending longitudinally therealong and the front end of the rack gear 76 has one end of a link chain 78 anchored relative thereto. The other end of the link chain 78 is trained about the sprocket wheel 44 and anchored relative thereto as at 80. In this manner, rearward movement of the rack gear 76 causes counterclockwise rotation of the sprocket wheel 44 and the ends of the link chain sections 56 anchored relative to the sprocket wheels 42 to be wound thereon. This, of course, causes the follower bars 54 to be pulled upwardly toward the braces 32.

The lower ends of the legs 26 support the opposite ends of the transverse shaft 82 therefrom and a lever assembly referred to in general by the reference numeral 84 has one end thereof oscillatably supported from the shaft 82, the lever assembly 84 including a pair of interconnected opposite side levers 86 and a center lever 88. The center lever 88 is tubular and rotatably journals a pair of opposite end transverse pulleys 90 and 92 therefrom and the central portion of the rear end of the longitudinal portion 20 journals a pulley 94 therefrom. In addition, the end of the lever assembly 84 remote from the shaft 82 oscillatably supports a foot treadle assembly 96 therefrom as at 98 and the foot treadle assembly 96 includes a center anchor portion 100 spaced radially outwardly of the axis of oscillation of the foot treadle assembly 96.

Figure 5:
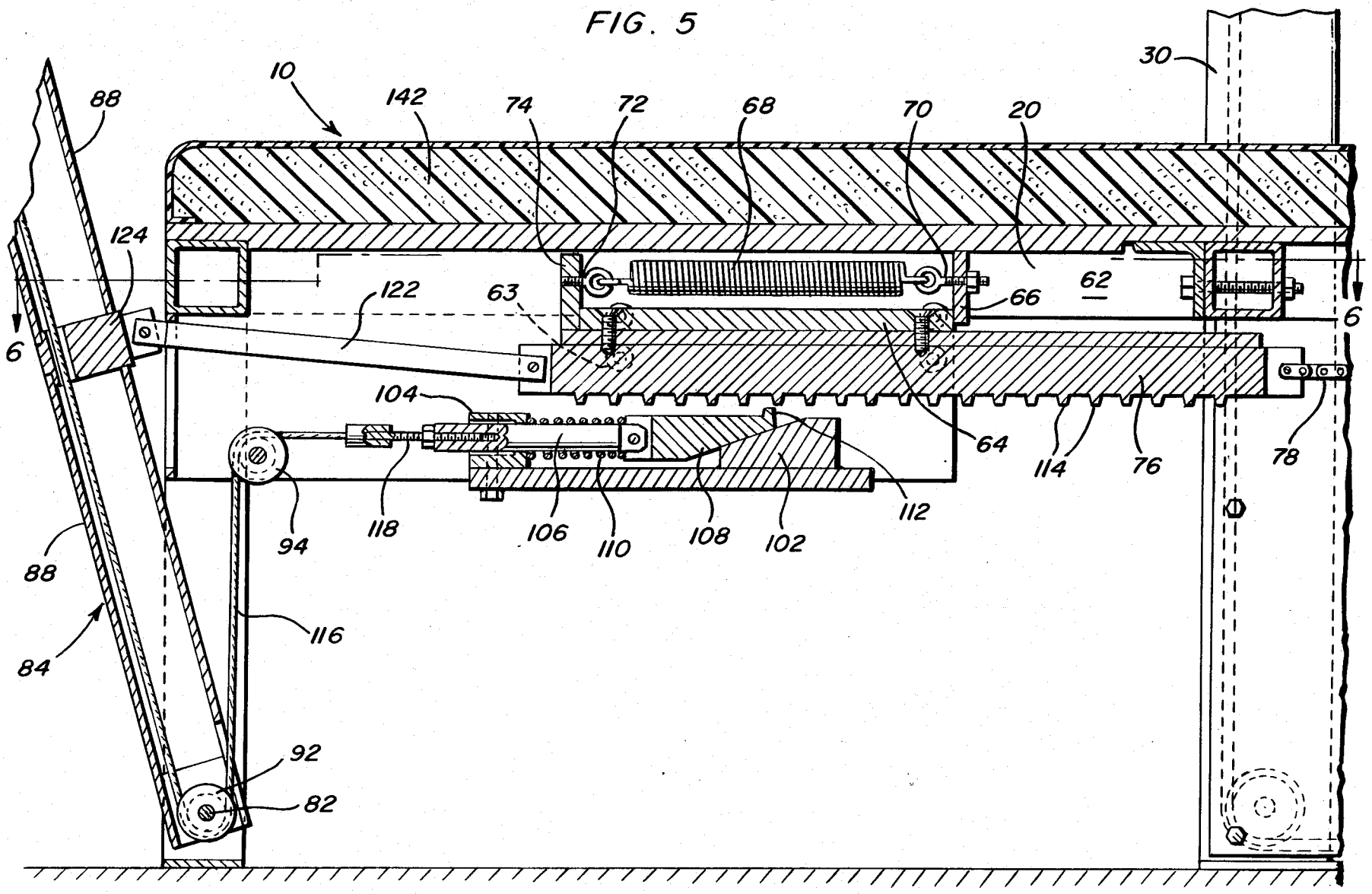
FIG. 5 is a fragmentary enlarged longitudinal vertical sectional view taken substantially upon the plane indicated by the section line 5—5 of FIG. 3.
Figure 6:
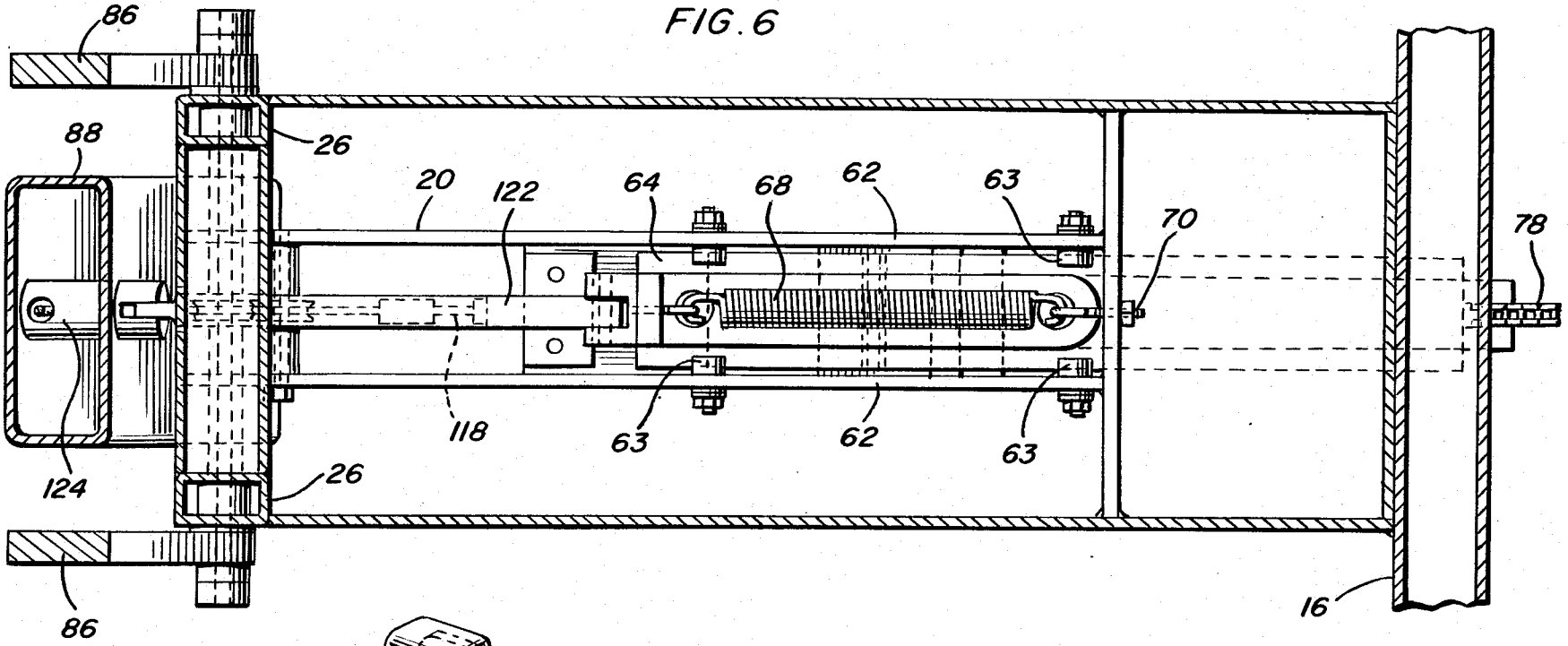
FIG. 6 is a horizontal sectional view taken substantially upon the plane indicated by the section line 6—6 of FIG. 5.
Figure 7:
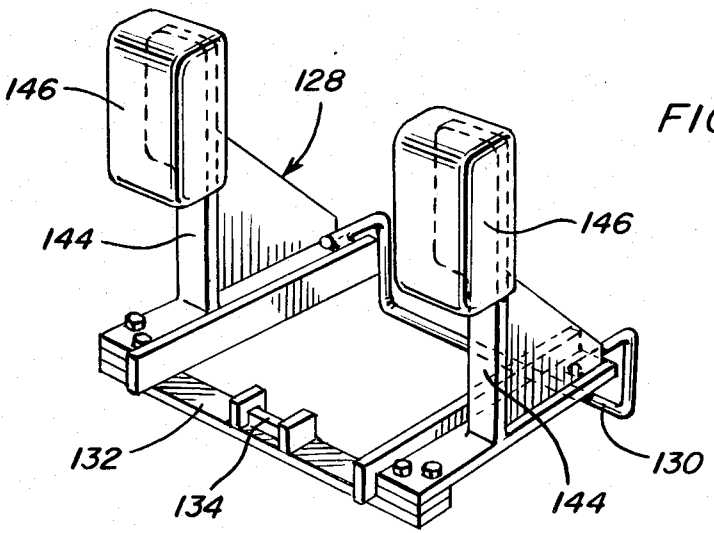
FIG. 7 is a perspective view of the shoulder abutment component of the exercising apparatus.

A wedge block 102 and shaft guide sleeve 104 are supported from the underside of the longitudinal portion 20 and a latch operating shaft 106 is slidable through the sleeve 104 and has a latch dog 108 pivotally supported on its end adjacent the wedge block 102. In addition, a compression spring 110 is disposed about the latch operating shaft 106 between the latch dog 108 and the sleeve 104 and yieldingly biases the latch operating shaft 106 to the right as viewed in FIG. 5, thereby tending to displace the latch dog 108 upwardly along the wedge block 102 for engagement of the tooth 112 of the latch dog 108 between adjacent teeth 114 on the rack gear 76. One end of a pull cable 116 is adjustably anchored to the shaft 106 as at 118 and the cable 116 passes about the pulleys 94, 82 and 90 and is anchored to the center anchor portion 100 of the foot treadle assembly 96 as at 120. In addition, a connecting link 122 is pivotally connected at its opposite ends to the rack gear 76 and an anchor 124 carried by the center leg 88. Accordingly, upon movement of the foot treadle assembly supporting end of the lever assembly 84 away from the front end of the apparatus 10, the rack gear 76 will be moved rearwardly against the tension of the spring 68 and a rearward pull will be exerted on the adjacent end of the link chain 78 to thereby cause the bars 54 to be raised. Also if the foot treadle assembly 96 is angularly displaced in a counterclockwise direction as viewed in FIG. 2 of the drawings, the compression spring 110 yieldingly biases the latch dog 108 upwardly along the wedge block 102 in order to engage the tooth 112 between adjacent teeth 114 on the rack gear 76. Thus, the follower bars 54 are prevented from downward movement along the upstanding members 28 and 30.

The head end 24 supports a shoulder abutment assembly 128 therefrom for guided shifting therealong and the shoulder abutment assembly 128 includes a downwardly displaced transverse handgrip 130. In addition, the assembly 128 includes a rear transverse brace 132 including an upstanding flange portion 134 and a lever 136 underlies the head end 24 and has its forward end pivotally supported from the head end 24 as at 138. The lever 136 includes longitudinally spaced downwardly opening notches 140 therein and the flange portion 134 may be selectively engaged in one of the notches 140 in order to retain the longitudinally shiftable shoulder abutment assembly 128 in adjusted position longitudinally of the apparatus 10. The apparatus 10 includes an elongated pad assembly 142 which overlies the longitudinal portion 20 and the center area of the main transverse base frame 16 and the shoulder abutment assembly 128 includes braced opposite side upstanding supports 144 from whose upper ends suitable pads 146 are supported. The pads 146 may be engaged with the shoulders of a person disposed on the pad assembly 142.

The front upstanding members 28 include opposite side reinforcing plates 150 supported therefrom and the plates 150 include vertically spaced horizontally registered pairs of bores 152 formed therethrough. In addition, a U-shaped slide 154 is provided on each front upstanding member 28 and includes apertures 156 formed therein selectively registrable with the vertically spaced pairs of bores 152. In addition, a pair of lock pins 158 are provided and may be passed through registered bores 152 and apertures 156 in order to retain the slides 154 in vertically adjusted positions on the reinforced vertical midporportions of the front upstanding members 28. The slides 154 define rearwardly and upwardly projecting hook portions 160 from which the opposite ends of the weighted bar 162 may be stationarily supported. The slides 154 are vertically adjustable on the forward upstanding members 28 in order that the weighted bar 162 may initially be supported in predetermined spaced position above the cushion or pad assembly 142.

In operation, the height of the slides 154 are adjusted as desired prior to use of the apparatus by a person wishing to carry out bench press exercises and the shoulder abutment assembly 128 is also adjusted as desired by upwardly displacing the rear end of the lever 136 and slidably shifting the assembly 128 to the position desired, after which the lever 136 may be allowed to drop downwardly to engage the flange portion 134 in one of the notches 140. Then, with a person to carry out bench press exercises disposed on the cushion or pad assembly 142 in the manner illustrated in phantom lines in FIG. 1 of the drawings, the feet of the user may be engaged with the foot treadle assembly 96. The user then may extend his hands upwardly to engage the bar 162 after the follower bars 54 have been vertically adjusted to a position slightly above the chest of the user. After the follower bars 54 have been adjusted, the toe portion of the foot treadle assembly 96 is angularly displaced rearwardly toward the left as viewed in FIG. 2 of the drawings in order to enable the compression spring 106 to displace the latch dog 108 to the right as viewed in FIG. 5 and position the tooth 112 between adjacent teeth 114 on the rack gear 76. Engagement of the tooth 112 between adjacent rack gear teeth 114 locks the rack gear 76 against displacement to the right as viewed in FIG. 5 and thus prevents the bars 54 from being lowered. Then, the user of the apparatus 10 may engage the bar 162 and lift it from the hook portions 160 for the purpose of carrying out bench press exercises.

Figures 2, 4:
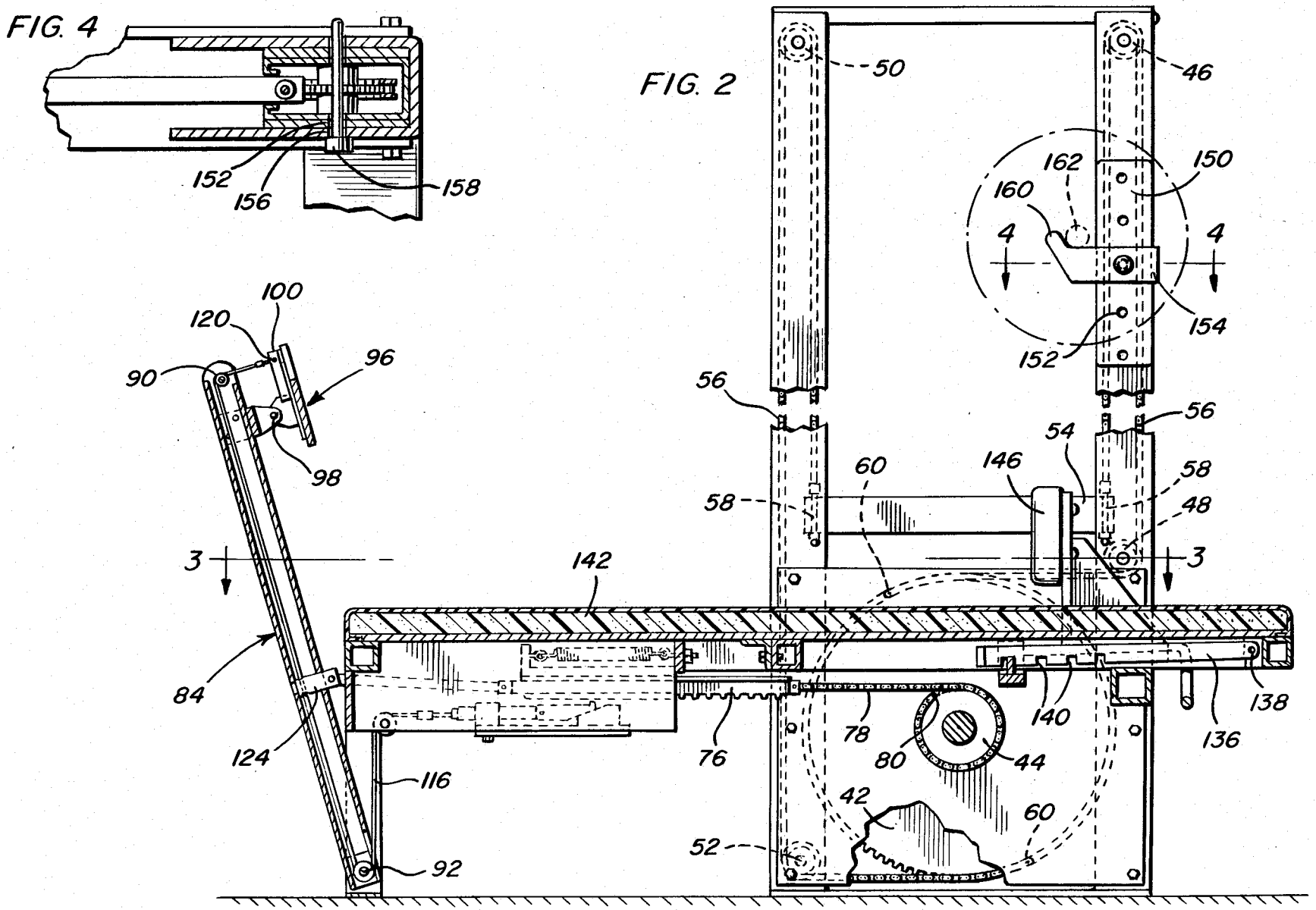
FIG. 2 is an enlarged fragmentary longitudinal vertical sectional view taken substantially upon the plane indicated by the section line 2—2 of FIG. 1.
FIG. 4 is a fragmentary horizontal sectional view taken substantially upon a plane indicated by the section line 4—4 of FIG. 2.

If at any time during the exercise period, the user cannot return the bar 162 to the rest position thereof supported from the slides 154, the exerciser may exert a rearward push upon the foot treadle assembly 96 whereupon counterclockwise angular displacement of the lever assembly 84 as shown in FIG. 2 will result in the rack gear 76 being pulled to the left and thus a pull to be exerted on the link chain 78. A pull to the left on the link chain 78 causes the sprocket wheels 142 to be angularly displaced in a counterclockwise direction as viewed in FIGS. 1 and 2 of the drawings and the follower bars 54 to be elevated for contact with the bar 162. At this point, combined arm and/or leg strength of the user may be used to displace the bar 162 upwardly to a level above the hook portions 160 after which the bar 162 may be rolled forwardly along the bars 54 and subsequently lowered into hooked support with the slides 154.

It may thus be seen as long as the user of the apparatus 10 properly initially elevates the bars 54 to a position above the chest of the user, the bar 162 cannot contact the chest of the user, even though the bar 162 might be dropped. The chains 56 and 78 are utilized to support the follower bars 54 in order to insure sufficient strength to overcome the force of impact should a heavily weighted bar 162 be dropped.

The shoulder abutment assembly 128 may be adjusted as desired and the expansion spring 68 serves to return the cantilever supported lever assembly 84 back toward its uppermost position.

It is to be noted that although the cushion or pad assembly and bench structure are substantially horizontally disposed, an inclined position of up to 75° could be utilized. In such case, the longitudinal portion 20 would be provided with a seat. By inclining the bench and cushion or pad assembly to an angle of approximately 60° different combinations of muscles may be exercised.

Further, each of the side members 12 and 14 defines a window opening therethrough above the corresponding bar 54 through which a weight bar end may be inserted. Also, the upstanding members include removable abutment pins which are disposed at a preselected elevation and are abuttingly engageable by the opposite ends of the bars 54 to limit downward movement of the bars 54 to a level which will prevent the bar 162 from contacting the chest, neck or head of the user. In such case it is not necessary for the user to otherwise adjust the height of the bars 54 before beginning bench press exercises.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercise device including an elongated bench including head and foot ends, a pair of upstanding opposite side guide structures supported on opposite sides of said head end, a pair of elongated generally horizontal follower means extending lengthwise in the longitudinal direction of said bench and mounted one from each of said guide structures for movement therealong, foot enagageable force means pivotally supported from said foot end of the bench for movement in the longitudinal direction of said bench and engageable by the feet of a person reposed on said bench with the legs of the person in bent condition, motion transmitting means operatively connected between said force means and said follower means for upwardly displacing said follower means in direct response to said force means being pivoted away from said head end, latch means pivotally supported from said force means which pivots between engaged and released positions and for releasably preventing downward movement of said follower means relative to said guide structures, said follower means being adapted to support the opposite ends of a weight bar extending therebetween and resting thereon.

2. The exercise device of claim 1 wherein said bench is substantially horizontally disposed.

3. The exercise device of claim 1 wherein each of said upstanding opposite side guide structures include a pair of front and rear upstanding members between which the corresponding follower means extends.

4. The exercise device of claim 3 wherein one pair of corresponding front and rear upstanding members include upwardly opening vertically adjustable weight bar end supporting hook means supported therefrom and projecting toward the other pair of corresponding upstanding members.

5. The exercise device of claim 1 wherein said head end of the bench includes a shoulder abutment assembly supported therefrom defining a pair of opposite side pads facing toward said foot end.

6. The exercise device of claim 5 including mounting means supporting said shoulder abutment assembly from said head end of the bench for adjustable shifting along said bench toward and away from said foot end of the bench.

7. The exercise device of claim 1 wherein said latch means includes a one way ratchet connection with said motion transmitting means.

8. The exercise device of claim 1 wherein said foot engageable force means comprises layer assembly pivotally supported from said foot end and including a free end portion equipped with foot engageable treadle means for engagement by the foot of the user of the device.

9. The exercise device of claim 8 wherein said treadle means is oscillatably supported from said free end portion and comprises an operator for activating and deactivating said latch means.

10. The exercise device of claim 1 wherein said guide structures define upstanding side frames and registered openings extending horizontally through said side frames including upstanding front and rear margins and through which the ends of a bar having weight discs thereon may be endwise inserted, said follower means defining lower margins of said openings:

11. The exercise device of claim 1 wherein said guide structures include weight bar end supporting upwardly opening hook portions projecting into said openings from the front margins thereof.

12. The exercise device of claim 11 wherein said hook portions and guide sturctures include coacting support means for supporting said hook portions in adjusted shifted positions along said guide structures.

13. An exercise device upon which a weight lifter may be supported in predetermined position for practicing "free" weight lifting exercises with a weighted bar to be oscillated vertically during the weight lifting exercise over a portion of the general chest, neck and head area of the weight lifter, said device including a horizontal support, a pair of laterally spaced uprights mounted from said support, each said upright having a horizontal follower bar mounted therein for guided vertical shifting relative to said support, a horizontal weight bar spanning between and supported from said support bars, a foot engageable member mounted from said support for back and forth movement in a path extending toward and away from one side of a vertical plane containing said weight bar and engageable by the feet of an exerciser disposed on said horizontal support when the exerciser's legs are bent, and motion transmitting means operatively connecting said foot engageable member and support bars for up and down movement of the bars in direct response to oscillation of the foot engageable member away and toward, respectively, said plane.

14. An apparatus for use in arm exercising with a "free" bar bell, said apparatus comprising a frame having a pair of spaced opposite side rear uprights and a corresponding pair of spaced opposite side front uprights, an elongated bench projecting rearwardly from between said opposite side uprights and including an outer rear end, a horizontal follower bar extending between and guidingly supported from each pair of corresponding front and rear uprights and displaceable upwardly therealong to levels spaced above said bench, a generally horizontal weighted bar including opposite ends disposed between the front and rear uprights at opposite sides of said bench and disposed above the corresponging follower bars, a foot engageable member mounted from said outer rear end of said bench for movement in the longitudinal direction of said bench and engageable by the feet of an exerciser disposed on said bench with his upper torso spaced between said follower bars, motion transmitting means operatively connecting said foot engageable member and follower bars for up and down movement of said bars along said uprights in direction response to movement of the foot engageable member away and toward, respectively, the end of said bench remote from said outer rear end, said follower means being adapted to support the opposite ends of said weight bar extending therebetween and resting thereon.

15. The define of claim 14 including latch means supported from said foot engageable member for shifting between engaged and released portions and releasably preventing downward movement of said lifting bars relative to said uprights.

16. The device of claim 15 wherein said latch means includes a one-way ratchet connection with said motion transmitting means.

* * * * *